United States Patent [19]

McCann

[11] Patent Number: 4,631,375

[45] Date of Patent: Dec. 23, 1986

[54] DELAYED ACTION LIQUID LEVEL SENSING APPARATUS

[75] Inventor: Gerald McCann, Valencia, Calif.

[73] Assignee: McCann's Engineering & Manufacturing Company, Los Angeles, Calif.

[21] Appl. No.: 678,270

[22] Filed: Dec. 5, 1984

[51] Int. Cl.[4] ..... H01H 35/18

[52] U.S. Cl. ..... 200/84 C; 73/313; 340/624; 307/118

[58] Field of Search ..... 361/395, 399; 73/308, 73/313, 319; 340/623, 624; 200/84 R, 84 C, 302, 61.2; 335/205, 207; 307/118

[56] References Cited

U.S. PATENT DOCUMENTS 3,437,771 4/1969 Nusbaum ..... 200/84 C
4,329,550 5/1982 Verley ..... 200/84 C

FOREIGN PATENT DOCUMENTS 2643355 3/1978 Fed. Rep. of Germany .... 200/84 C

*Primary Examiner*—G. P. Tolin
*Attorney, Agent, or Firm*—Lyon & Lyon

[57] ABSTRACT

An improved low liquid level float control apparatus particularly adapted for use in vessels or tanks containing a fluid of the type utilized in liquid vending machines is disclosed. An electronic control unit has a probe section extending downwardly therefrom containing a reed switch, which is activated by the passage of a first magnet located in the lower portion of a float vertically along the probe section. A second magnet is secured along the upper portion of the float. Metal stops are provided along the probe section to determine the range and movement of the float and to effect a time delay, thus reducing the possibility of intermittent on-off operation of associated pump elements.

7 Claims, 2 Drawing Figures

DELAYED ACTION LIQUID LEVEL SENSING APPARATUS

BACKGROUND OF THE INVENTION

This invention relates to switch devices having liquid level control capability and more particularly to those used to control the level of carbonated liquid contained in a vessel or storage tank associated with ordinary liquid vending machines.

Previously, vending machines of the aforementioned type have contained vessels for storage of carbonated liquid which when empty would necessitate replacement of the vessel. Because of the difficulty in changing the vessel, it became desirable to make the vessel or storage tank replenishable, thereby obviating the necessity of replacing the vessel when empty. Concurrent with this desired development, it was necessary to have a sensing device adapted to determine the level of carbonated fluid or the like located within the replenishable vessel. Probe devices were developed in which an annular magnet located in a float element traversed vertically with the float element along a probe thereby activating or deactivating a reed switch of the conventional type located within the probe. Thus the level of fluid in the vessel was monitored and appropriate automatic filling apparatus activated when necessary.

Similarly, it became desirable to have a liquid level control device able to maintain an extended fluid inlet cycle due to the dilaterious effect upon pump motors caused by rapid on-off operation, occasioned by small changes in the liquid level within the vessel and associated vertical traversal of the annular magnet. This has previously been accomplished, as in the U.S. Pat. No. 3,408,053, by an internally disposed magnetic sleeve element which caused the latch type components of a conventional reed switch to maintain a juxtaposed relationship longer than would occur under normal activation by the position of an annular ceramic magnet located in the float element.

SUMMARY OF THE INVENTION

The present invention is directed to a low level fluid sensing and reed switch activation device with substantially different delay control features. The sensing device comprises a buoyant element which has an annular magnetic component integral with its lowermost portion. The buoyant element is capable of traversing in a vertical plane along a probe section suspended within the fluid medium. The buoyant element is capable of being suspended in a uppermost position by a fluid within a vessel against the force of gravity and is capable of traversing to a lowermost position along the probe section in the absence of the fluid.

The traversal of the buoyant element containing the annular magnetic element opens or closes a reed switch, which either activates or deactivates an electrical circuit, which in turn energizes a pump device for replenishing the fluid in the vessel when near empty. The reed switch is located within the internal portions of the probe section. The probe section is adapted to be suspended from the top wall of the vessel or secured to a control unit, which is secured to the top wall of a vessel.

The placement of a second magnet in the uppermost portion of the bouyant element results in a delayed action effect. A small annular piece of stainless steel is placed at both the upper and lower end of the probe section. These stainless steel pieces determine the range of movement of the float. Under normal circumstances the reed switch latch components would immediately open when not under influence of the lowermost magnet, thus terminating the operation of the replenishing pump. The lowermost magnet will attach itself to the lower piece of stainless steel and cause a longer fill cycle to occur—until the fluid is near the top of the vessel. At that point the float element will finally break away from the lower piece of stainless steel and will immediately move to the uppermost position where the top magnet will attach itself to the upper piece of stainless steel. Thus the dilaterious effect of continuous on-off operation of the motor operating the pump replenishing the tank or vessel is dramatically reduced.

It is accordingly a principal object of the present invention to provide an improved liquid level control and switch activating device which is adapted for use in vending machines or the like.

It is another object of the present invention to provide a float control device especially adapted for use in a liquid vending machine with a replenishable fluid supply.

It is another object of the present invention to provide a device which has the ability to selectively control the delay time of a switch which activates replenishing pump elements, without having to disassemble the device.

It is a further object of the present invention to provide a device capable of being implanted within a vessel containing carbonated fluid and have the active components protected in a medium impervious to the chemically active fluid contained therein.

It is a further object of the present invention to provide a further delayed action feature to the float control device.

These and other features, aspects, and advantages of the present invention will become better understood with reference to the appended claims, the following description, and accompanying drawings wherein;

DESCRIPTION OF THE PREFERRED EMBODIMENT

The invention of this application is an improvement upon the invention disclosed in U.S. Pat. No. 4,329,550.

Figure 1:
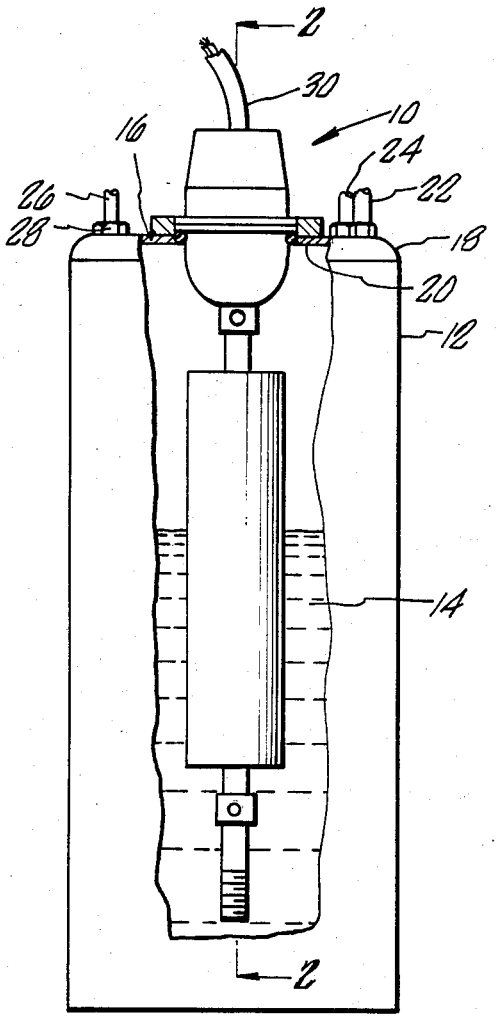
FIG. 1 is a broken away view of a tank structure illustrating the position of the probe float apparatus of the present invention when in use.

As shown in FIG. 1, the invention of the present application consists of a liquid level sensing apparatus 10, which is of a generally elongated shape and fits snugly within a replenishable tank 12 containing a body of carbonated fluid 14 or the like. The tank 12 has an orifice 16 adapted to receive the liquid level sensing apparatus 10, which is suspended from the top 18 of the tank 12. A hermetic sealing component 20 is provided between the tank 12 and the apparatus 10 to maintain the carbonation level of the fluid 14 contained within the tank 12.

If used for the purposes of holding carbonated fluid, the tank 12 also contains an inlet tube 22 for carbondioxide, an inlet tube 24 for water and an outlet tube 26 for the carbonated fluid. Lock nuts 28 provide for the easy removal of the tubes 22, 24, and 26 and further are adapted to provide a hermetic seal with the tank 12. A cord 30 protrudes from the top of the liquid level sensing apparatus 10 and is provided with a plug (not shown) for use with a motor (not shown) which activates pumping elements replenishing the fluid 14 within the tank 12.

The invention of the present application may be utilized with electric motors or other fluid pump devices with the same degree of effectiveness. It should also be noted that although the present application is directed toward the use of the present invention with vessels containing carbonated fluids, as used in liquid vending machines, the probe float apparatus 10 may be used with other systems wherein it is desirable to maintain pre-set fluid levels and activate replenishing devices when the fluid levels drop below a certain minimum. In those instances removal of one of the inlet tubes 22, 24, 26 will facilitate utilization of the float apparatus 10 in a one-fluid system.

Figure 2:
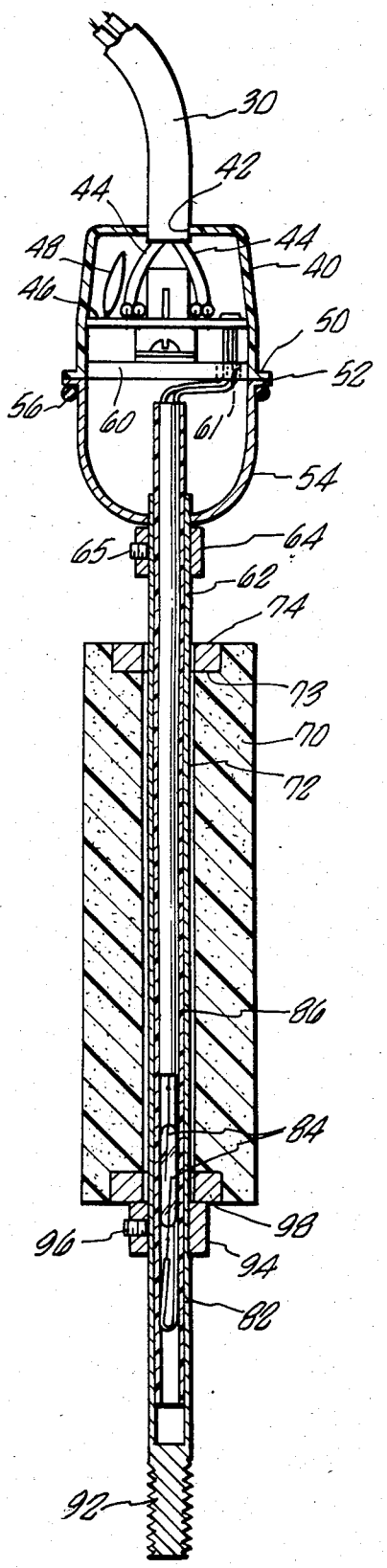
FIG. 2 is a cross-sectional of the probe float apparatus embodying the elements of the present invention.

As shown in FIG. 2, the invention of the present application in further detail is comprised of an open-ended substantially cylindrical shell 40 composed of an elastomer such as polyethylene or molded nylon, the shell 40 having generally flexible characteristics. In the upper area of the shell 40 there is provided an orifice 42 from which the cord 30 protrudes. The cord 30 has two leads 44 each of which are attached by conventional means to electronic circuitry provided within the cylindrical housing 40. These same leads terminate in a plug (not shown) at the distal end of the cord 30 for activation of the pumping elements. An integrated circuit card 46 provides attachment loci for the leads 44 by welding or other appropriate methods and acts a base for the attachment of other electrical components 48 which will be described in more detail later in the application. At the lowermost portion of the housing 40 a flange 50 is provided, which abuts against an opposing flange 52 of a downwardly projecting conical housing 54. The conical housing 54 is made up of a material substantially impervious to the chemically active body of fluid 14 found within the tank 12, as movement of the tank 12 may cause a splashing of the liquid over the housing 54. At the uppermost portion of the housing 54 and on the outside thereof is an o-ring 56 which is used to hermetically seal the liquid level sensing apparatus 10 to the top 18 of the tank 12. A base plate 60 fits snugly within the upper section of the housing 54 and has an aperture 61 for permitting the entry of electrical connections into the cylindrical shell 40 and for further acting as a internal seal to the possibility of any fluid 14 entering the cylindrical shell 40.

Projecting downwardly from the housing 54 is a probe 62 which is secured rigidly to the housing 54 by welding or other appropriate techniques of fastening such as crimping. The probe 62 is made of stainless steel in the preferred embodiment; however, it is apparent that other materials may be used in accordance with the type of fluid 14 to be stored in the tank 12. The probe 62 projects slightly into the housing 54 thus providing an additional attachment surface for these two components. At the uppermost portion of the probe 62 is an upper stop 64 which fits entry upon the probe 62. A conventional lock screw 65 maintains the stop 64 to the probe 62. It should be noted that within the shell 40 and housing 54 there may be injected a medium, which by surrounding the internal components, will make those components impervious to any chemically active fluid 14 that may enter the shell 40 or housing 54.

A float element 70 is generally cylindrical in shape and is adapted to traverse vertically along the probe 62 due to the presence of a slot 72 running along the vertical length of the element 70 and substantially in the center thereof. The float element 70 may be either solid or have hollow portions depending upon the desired responsiveness of the float element 70 to liquid level changes within the tank 12. An upper magnetic element 74 is substantially annular in shape and is integral with the float element 70 at its uppermost section by being imbedded within a groove 73 in the element 70. The magnetic element 74 because seated within the float 70 traverses vertically with the float 70 in the presence or absence of the fluid 14 in the tank 12.

Although shown to be cylindrical, the float 70 may be constructed in various shapes without departing from the spirit or scope of the invention. Similarly, the float element 70 may be made of any material that is impervious to a chemically active fluid 14, and has a specific gravity less than the fluid 14, such as, styrofoam, neoprene or foam polyethylene.

At the lowermost portion of the probe 62, is a screw section 92 integral with the probe 62 and adapted to receive a lower stop 94 which is substantially annular in shape. A set screw 96 is operative to suspend the stop 94 along the probe 62. A lower magnetic element 98 is located within the lowermost portion of the float 70. In the preferred enbodiment the stops 64, 94 are made of 430f stainless steel.

Located within the probe 62 is a normally-open reed switch 82 which has latch type elements 84 movable in response to a magnetic field oriented parallel to the probe 62. The latch elements 84 move radially within the probe 62 toward each other thereby contacting, when under the influence of the magnet 98. The reed switch 82 is disposed within an electrically insulating material 86 which extends throughout the entire probe 62 and vertically to a position just short of the base 60. This material 86 keeps the chemically active fluid 14 from interfering with the reed switch 82 when in use. The reed switch 82 also has two leads, one extending from each at the latch elements 84, the leads passing through the base 60 and being soldered to the underside of circuit card 46. The leads are also entirely surrounded by the material 86 when in the probe 62.

As stated earlier, and as shown in FIG. 2, located within the housing 40 upon the integrated circuit 46 are a series of electrical components 48 which constitute the activation circuitry for an electric motor or other pumping devices (not shown). Briefly, the electric circuitry is substantially the same as shown in U.S. Pat. No. 3,408,053, which is incorporated herein by reference. The electrical components 48 are surrounded by a potting material making the components impervious to the splashing or turbulence of a fluid 14 within the tank 12. The potting material also acts as a heat sink material discharging any heat in the integrated circuit 46 through the walls of the housing 40.

In operation, when a sufficient quantity of carbonated fluid or the like is contained within the tank 12 the float 70 is moved to an upper position, said movement terminated by the upper stop 64. At this point in time, the magnetic element 98 does not have an actuable influence upon the reed switch 82. After a certain amount of the carbonated fluid 14 is removed from the tank for use in a vending machine or the like, the float 70 will traverse vertically downward along the probe 62 to a position wherein the magnetic element 98 has an actuable influence upon the latch elements 84 of the reed switch 82 causing them to radially move toward each other. The lower stop 94 terminates the movement of the float 70 in a downward direction. At a point in time, the latch elements 84 will contact one another thereby energizing the electronic components 48 thus starting the pump (not shown) which then replenishes the fluid 14 within the tank 12, through inlet tube 24. The fluid 14 added by the pump will continue to rise along the probe 62 within the tank 12 until such time as the float element 70 breaks away from the lower stop 94. As the float element 70 moves upward the magnetic element 98 will no longer have an actuable influence upon the reed switch elements 84. At this point in time the reed switch elements 84 open thus de-energizing the electric components 48 and turning off the pump motor. Thus a delayed action results.

In this improved version the upper magnetic element on top of the float 70 is also operative for a delayed effect. The lower magnetic element 98 on the float 70 is actually the magnet that effects the reed switch 82 and causes it to turn on or turn off. The upper magnetic element 74 is simply used to attach itself to the upper stop 64 when the float 70 rises to the top (when the water level in the tank is at its high end). When the water is being drawn out of the carbonator tank and reaches approximately the mid point of the float 70, the weight of the float 70 is then great enough to cause the float 70 to break away from its attachment to the upper stop 64. As it breaks away from the upper stop 64, it will move quickly down and then reattach itself to the lower magnetic element 94. In its movement downward within 1/16th of an inch of the bottom of the stop 94, its magnetic influence will effect the open reed switch 82 causing it to close and thereby starting the pump motor. As water comes into the tank and is approaching a point that is approximately one inch from the top of the float 70, the buoyancy of the float 70 will become such that it will cause it to break away from its attachment to the lower stop 94 on the bottom thereby turning off the pump motor.

It is significant to note that none of the elements which may be damaged by the chemically active fluid 14 are located in a position wherein said fluid 14 will interact with them. In this regard magnetic elements should be made with a material, namely, ceramic or alnico, which are substantially impervious to the presence of a chemically active fluid. As a result of this configuration, the liquid level sensing apparatus 10 of the present application may be used for long periods of operation without repair.

Although the present invention has been described in considerable detail it should be noted that other versions are possible. Therefore, the spirit and scope of the appended claims should not be limited to the restrictions of the preferred embodiment contained herein.

I claim:

1. In a liquid level float controlled switch apparatus having a housing within which electrical components are present in a fluid-tight medium, and a probe section integral with and suspended from said housing; the improvements comprising, in combination:

a float means disposed about said probe section for traversing said probe section in a vertical plane, a first magnet integral with said float means and positioned in a lower portion of said float means, a magnetically operated switch means located within said probe section and having oppositely facing magnetic elements adapted to contact one another in response to the presence of a magnetic field occasioned by the position of said first magnet relative to said magnetic elements, a lower magnet spaced apart on the same axis from said magnetic switch means, said lower magnet slidably engaged with the exterior of said probe section;

a second magnet integral with said float means and positioned in an upper portion of said float means in a vertically spaced apart relationship with respect to said first magnet;

an upper magnet located along said probe section at the uppermost portion thereof.

2. The liquid level float controlled switch apparatus of claim 1, which includes, a means for adjusting the relative vertical position of said lower stop in relation to the magnetic switch means.

3. In a liquid level float controlled switch apparatus having a housing adapted to be secured to a tank structure, and having a probe section, which has top and bottom restraining elements, said probe section suspended from said housing into a fluid medium, the improvement comprising, in combination:

a float means for traversing vertically along said probe section from a first position at the bottom restraining element to a second position at the top restraining element, a first magnet integral with a lower portion of said float means, a magnetically actuated switch means disposed within said probe section for energizing an electric circuit, said switch means having oppositely facing latch elements, a lower magnet slidably engaged with the lower most external portion of said probe section, said lower magnet vertically spaced a discreet distance from said switch means on the same axis, whereby movement of said float means within a determined range causes said first magnet to move said latch elements into a contracting relationship, thus energizing said electric circuit, said contacting relationship being extended in time due to the magnetic influence of said lower magnet upon said first magnet;

a second magnet integral with said float substantially in the opposite vertical position on said float from said first magnet;

an upper magnet slidably located along said probe; whereby when said float is in said second position magnetic influence of said second magnet upon said upper magnet will maintain said float means in said second position for an extended period.

4. The liquid level float controlled switch apparatus of claim 3, wherein said top and bottom restraining elements are made of 430f stainless steel.

5. The liquid level float controlled switch apparatus of claim 4, which includes means for adjusting the position of said top and bottom restraining elements along said probe section.

6. In a liquid level float controlled switch apparatus, having a housing with a probe section integral therewith and suspended therefrom into a liquid medium and an electrical circuit disposed within said housing; the improvement comprising, in combination, an electrically nonconductive liner element enclosed within said probe section, a magnetically actuated switch means disposed within said liner element and having two leads passing therefrom, said switch means having a pair of oppositely positioned magnetically moveable latch elements, said latch elements each having an electrically conductive material integral with only one of said leads, a float means adapted to traverse vertically along said probe section, a first magnet integral with said float means and positioned in a lower portion of said float means, a second magnet integral with said float means displaced a discreet vertical distance from said first magnet;

a stop means secured to said probe section, said stop means adapted to restrain movement of said float means in a downward direction along said probe section, a lower magnet for continuously imparting a residual magnetic force upon said latch elements, said lower magnet being spaced a discreet vertical distance along the same axis from said latch elements, said lower magnet slidably located on the exterior of said probe section, an upper magnet located along an uppermost portion of said probe section;

whereby movement of said float means along said probe section causes said magnetic latch elements to contact one another when said first magnet has a magnetically actuable influence on said latch elements, and to remain in contact for a longer period of time because of a magnetic attraction between said first magnet and said lower magnet, and whereby said second magnet and upper magnet are operative to delay downward transversal of said float and prolong non-contact of said latch elements.

7. The apparatus of claim 6, which includes means for varying the position of said lower stop vertically along said probe section.

* * * * *

UNITED STATES PATENT AND TRADEMARK OFFICE

CERTIFICATE OF CORRECTION

PATENT NO. : 4,631,375

DATED : December 23, 1986

INVENTOR(S) : Gerald McCann

It is certified that error appears in the above-identified patent and that said Letters Patent is hereby corrected as shown below:

Column 3, line 33, please insert the word "as" after the word "acts" and before the word "a". The line should now read "welding or other appropriate methods and acts as a base".

Column 3, line 50, please delete the word "a", which was incorrectly used and insert in its place the word "an".

Signed and Sealed this

First Day of September, 1987

*Attest:*

*Attesting Officer*

DONALD J. QUIGG

*Commissioner of Patents and Trademarks*